US008281849B2

(12) United States Patent
Grözinger et al.

(10) Patent No.: US 8,281,849 B2
(45) Date of Patent: Oct. 9, 2012

(54) HEAT EXCHANGER

(75) Inventors: Steffen Grözinger, Vaihingen (DE); Horst Rothenhöfer, Lauffen (DE); Volker Velte, Ötisheim (DE)

(73) Assignee: Behr Industry GmbH & Co., Stuttgart (DE)

( * ) Notice: Subject to any disclaimer, the term of this patent is extended or adjusted under 35 U.S.C. 154(b) by 1243 days.

(21) Appl. No.: 12/066,767

(22) PCT Filed: Sep. 7, 2006

(86) PCT No.: PCT/EP2006/008736

§ 371 (c)(1),
(2), (4) Date: Mar. 13, 2008

(87) PCT Pub. No.: WO2007/031229

PCT Pub. Date: Mar. 22, 2007

(65) Prior Publication Data

US 2008/0283232 A1 Nov. 20, 2008

(30) Foreign Application Priority Data

Sep. 14, 2005 (DE) ..... 10 2005 043 731

(51) Int. Cl.
*F28F 3/08* (2006.01)

(52) U.S. Cl. ..... 165/167

(58) Field of Classification Search ..... 165/166, 165/167

See application file for complete search history.

(56) References Cited

U.S. PATENT DOCUMENTS

| | | | | |
|---|---|---|---|---|
| 4,669,532 | A * | 6/1987 | Tejima et al. | 165/297 |
| 5,121,790 | A * | 6/1992 | Persson | 165/140 |
| 6,070,428 | A | 6/2000 | Higashiyama et al. | |
| 6,161,615 | A | 12/2000 | Brieden et al. | |
| 6,340,054 | B1 | 1/2002 | Schwarz et al. | |
| 6,814,133 | B2 * | 11/2004 | Yamaguchi | 165/41 |
| 6,857,468 | B2 | 2/2005 | Emrich | |
| 7,108,054 | B2 * | 9/2006 | Dilley et al. | 165/167 |

FOREIGN PATENT DOCUMENTS

| | | | |
|---|---|---|---|
| DE | 197 22 074 | A1 | 12/1998 |
| DE | 197 23 159 | A1 | 12/1998 |
| DE | 199 39 264 | A1 | 2/2001 |
| DE | 102 11 368 | A1 | 9/2002 |
| DE | 103 24 089 | A1 | 9/2004 |
| EP | 1 191 302 | A2 | 3/2002 |
| EP | 1 288 604 | A2 | 3/2003 |
| FR | 2 572 798 | A1 | 5/1986 |
| GB | 2 381 306 | A | 4/2003 |
| WO | WO 2005/026639 | A1 | 3/2005 |

* cited by examiner

*Primary Examiner* — Teresa Walberg
(74) *Attorney, Agent, or Firm* — Foley & Lardner LLP

(57) ABSTRACT

The invention relates to a heat exchanger with at least two plate-shaped flow ducts which are in parallel to one another and at a distance from one another and have a flow connection through at least one connecting duct (8) which spans the distance. It is proposed that the at least one connecting duct (8) be formed by two self-centering tube connectors (4, 6) which can be plugged one into the other.

9 Claims, 4 Drawing Sheets

HEAT EXCHANGER

Figure 1C:
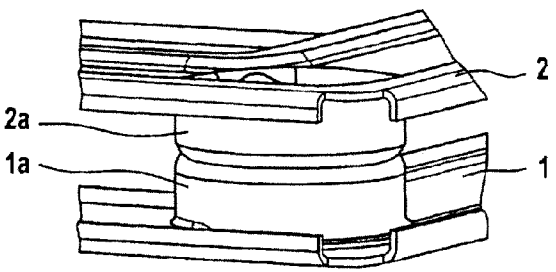
Fig. 1c Prior Art

Heat exchangers with disk-shaped or plate-shaped flow ducts are known in numerous embodiments, for example as plate-type oil coolers, plate-type evaporators or so-called stacked-plate heat exchangers. Said heat exchangers are composed of a plurality of identical sheet metal parts which are arranged or stacked one on top of the other, form flow ducts and are connected to one another by means of soldering. The flow ducts which are arranged one above the other are flow-connected by means of transversely-running connecting ducts which act as collecting and distributing ducts. It is know to form the connecting ducts as cup-shaped embossed portions and to solder these to one another in the region of a planar circular-ring-shaped face, with the cups being formed out of the disks or plates of the flow ducts. Said known connecting ducts have the disadvantage that the throughflow resistance is relatively high since the flow cross section is narrowed by the cup design. This increases the pressure drop across the heat exchanger.

It is an object of the present invention to improve a heat exchanger of the type specified in the introduction with regard to its pressure drop caused by the flow resistance in the connecting ducts.

It is provided according to the invention that the connecting duct is formed by pipe sockets which can be plugged one into the other and are self-centering. The end regions of the pipe sockets, which can preferably be produced as rim holes, are of conical design and are specifically conically flared or conically tapered, in each case with the same angle, such that said end regions can be plugged one into the other and bear against one another. A centering action is generated by the conical end regions as they are plugged one into the other. At the same time, a contact face which can be soldered is generated, so that a fluid-tight connecting duct between adjacent flow ducts is generated. The shaping according to the invention provides the advantage of a low flow resistance for the connecting duct, since the latter is of virtually smooth-walled design and has no projecting edges. Also provided is the advantage of an increased soldering surface and therefore a higher strength, in particular internal pressure strength, for the heat exchanger. It is also advantageous that the flow speed in the connecting duct is lower as a result of the greater flow cross section, as a result of which the pressure drop is likewise reduced. As a result of the centering action, further centering means for positioning the plate-shaped flow ducts are made superfluous.

The connecting ducts according to the invention with the conical end regions can preferably be used in plate-type heat exchangers as are known per se, with the pipe sockets, by being plugged one into the other, forming a distributing and a collecting duct which in each case have the advantage of a low throughflow resistance.

According to one particular embodiment of the invention, the flow ducts can be designed as annular ducts, preferably with a square outline, that is to say as per the previous patent application from the applicant with the official file reference 10 2005 004 777.7.

Exemplary embodiments of the invention are illustrated in the drawing and are explained in more detail below.

Figure 1D:
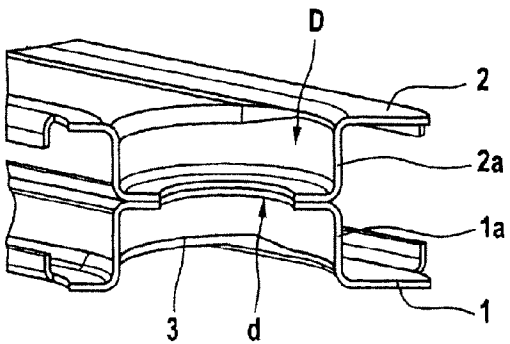
Fig. 1d Prior Art
Figure 1A:
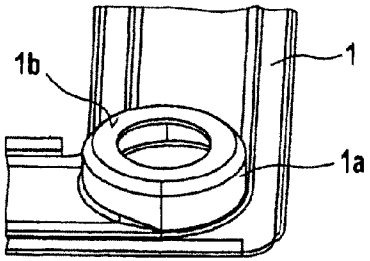
Fig. 1a Prior Art
Figure 1B:
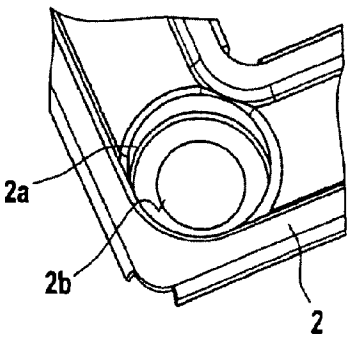
Fig. 1b Prior Art
Figure 2:
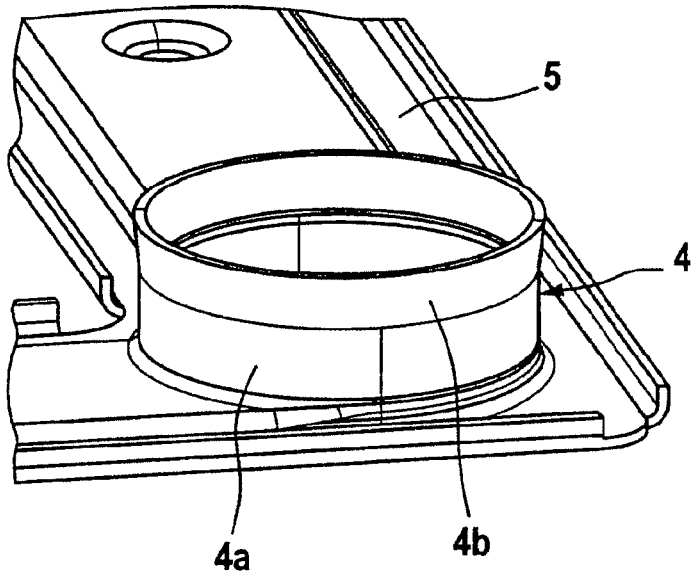
Figure 3:
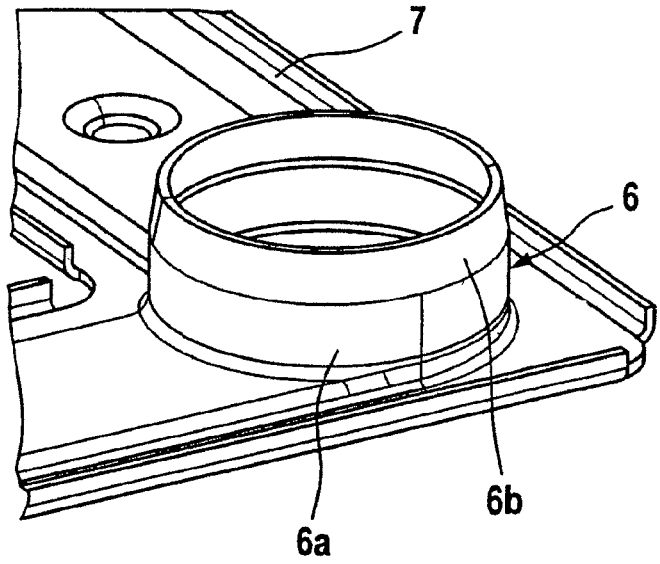
Figure 5A:
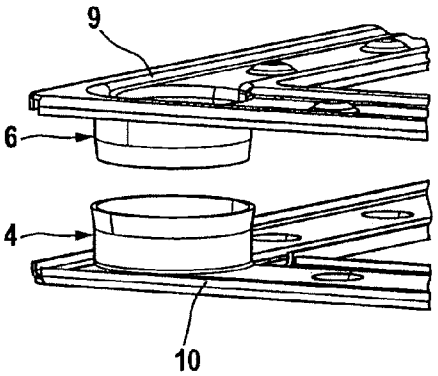
Figure 5B:
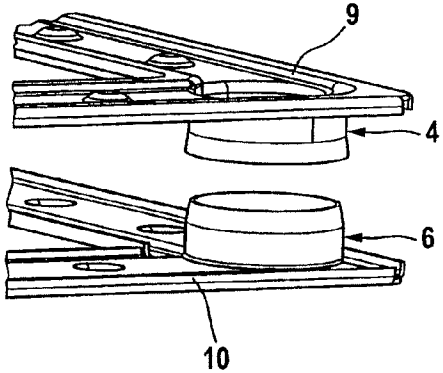
Figure 4:
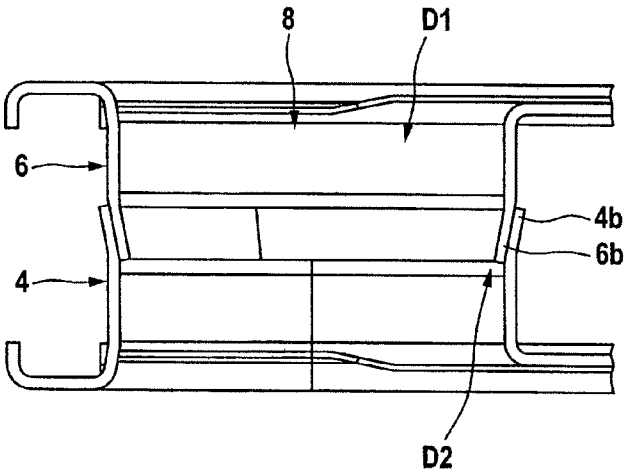
Figure 6A:
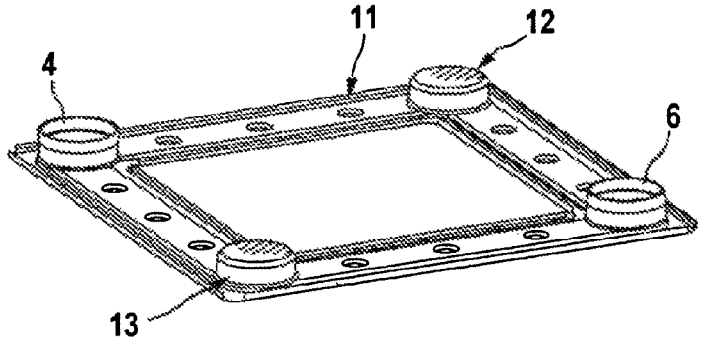
Figure 6B:
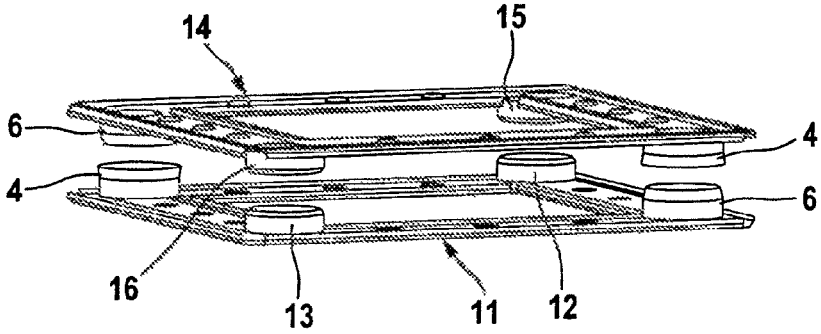
Figure 6C:
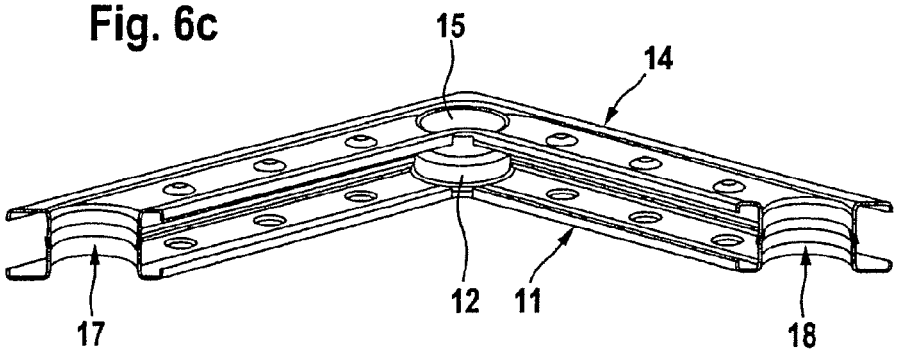

In the drawing:

FIGS. 1*a*-1*d* show a heat exchanger with a connecting duct as per the prior art, FIG. 2 shows a pipe socket according to the invention with conical flaring, FIG. 3 shows a pipe socket according to the invention with conical tapering, FIG. 4 shows a connecting duct with pipe sockets plugged one into the other, FIGS. 5*a*, 5*b* show plates of a heat exchanger with pipe sockets according to the invention, before joining, FIG. 6*a* shows a base plate of a heat exchanger, FIG. 6*b* shows two plates arranged one above the other, before joining, and FIG. 6*c* shows two plates after joining and soldering.

FIGS. 1*a* to 1*d* show a heat exchanger with flow ducts and a connecting duct as per the prior art.

FIG. 1*a* shows a lower plate 1 of a flow duct with an upwardly-embossed, approximately cylindrical cup 1*a* which has a planar, circular-ring-shaped soldering face 1*b*.

FIG. 1*b* shows a lower plate 2 of a flow duct with a downwardly-embossed, approximately cylindrical cup 2*a* which has a planar, circular-ring-shaped soldering face 2*b*.

FIG. 1*c* shows the connection of the two plates 1, 2, with the circular-ring-shaped faces 1*b*, 2*b* lying one on top of the other.

FIG. 1*d* shows a section through a connecting duct 3 which is generated by the two cup-shaped embossed portions 1*a*, 1*b*, 2*a*, 2*b* which are placed one on top of the other and are soldered to one another. A diameter reduction, specifically from a maximum diameter D to a minimum diameter d, is generated in the region of the soldered circular-ring-shaped faces. Said known design of the connecting duct 3 leads to an increased flow speed and to an increased pressure loss across the heat exchanger.

FIG. 2 shows a design according to the invention of a pipe socket 4 which is formed out of a plate 5 which delimits a flow duct. The pipe socket 4 is composed of a round cylindrical section 4*a* and a conically flared section 4*b*. Said pipe socket 4 is produced initially as a cylindrical rim hole, with subsequent conical flaring of the section 4*b*.

FIG. 3 shows a pipe socket 6 which is formed out of a plate 7 and which has a round cylindrical section 6*a* and a conically tapered section 6*b*.

FIG. 4 shows the two pipe sockets 4, 6 after joining and soldering, with the same reference symbols being used for identical parts. The conically tapered region 6*b* is plugged into the conically flared region 4*b* and forms an annular conical contact face for the soldering of the two pipe sockets 4, 6. As a result of the low degree of conicity of the two end regions 4*b*, 6*b*, there is only a slight change in the inner diameter. The pipe sockets 4, 6 which are joined into one another form a connecting duct 8 which has a maximum diameter D1 and an approximately identical minimum diameter D2 without any projecting edges, and therefore a relatively low throughflow resistance.

FIGS. 5*a* and 5*b* show two corner details of two plates 9, 10 which have in each case one conically flared pipe socket 4 and one conically tapered pipe socket 6. The plates are parts of annular flow ducts (not illustrated here).

FIG. 6*a* shows a plate 11 which is designed as a square annular duct and which has a conically flared pipe socket 4 and a conically tapered pipe socket 6 which are situated in each case diagonally opposite one another. Arranged in the region of the other corners are cup-shaped closed rim holes 12, 13 which are likewise formed out of the plate 11 and serve as spacers and for support.

FIG. 6*b* shows two plates 11, 14 arranged one above the other before joining, which plates 11, 14 are of identical design but are rotated by 180° (about a diagonal). It is therefore possible for conically flared and conically tapered pipe sockets 4, 6 in each case on diagonally opposite corners to be joined, and for closed rim holes 12, 13 and 15, 16 to come into contact as spacers.

FIG. 6*c* shows the two plates 11, 14 as a detail and partially in section, with the closed rim holes 12, 15 bearing against one another with their planar faces and being soldered there—there is therefore only support taking place here and no passage of flow. Formed at the two diagonally opposite corners are connecting ducts 17, 18 which connect the upper plate 14 and the lower plate 11 to one another, which plates 14 and 11 are in each case part of an annular flow duct. A heat exchanger of said type, with preferably square annular ducts, is disclosed in the previous application from the applicant with the official file reference 10 2005 004 777.7—the subject matter of said previous application is included in its entirety in the content of disclosure of this application.

In contrast to the exemplary embodiment described above and illustrated in the drawing, it is possible for the flow cross section of the connecting ducts or of the pipe sockets which are plugged one into the other to be elliptical or oval or to have other shapes. The pipe socket plug-type connection according to the invention can be used for all types of disk and plate heat exchangers.

The invention claimed is:

1. A heat exchanger comprising:

a first plate-shaped flow duct and a second plate-shaped flow duct which are arranged parallel to each other with a spacing between the first and second plate-shaped flow ducts, wherein the first plate-shaped flow duct comprises a first pipe socket and the second plate-shaped flow duct comprises a second pipe socket, wherein the first and second pipe sockets form a connecting duct by plugging into each other, the first and second pipe sockets being self-centering, wherein the connecting duct flow-connects the first plate-shaped flow duct and the second plate-shaped flow duct and bridges the spacing, wherein the first and second pipe sockets each comprise a cylindrical base region and a conical end region, wherein the first and second plate-shaped flow ducts are formed by a first plate and a second plate, respectively, and wherein the first and second plates form annular ducts with a square outline.

2. The heat exchanger as claimed in claim 1, wherein the first and second pipe sockets can be produced as rim holes.

3. The heat exchanger as claimed in claim 1, wherein the conical end regions of the first and second pipe sockets form an annular conical contact face.

4. The heat exchanger as claimed in claim 1, wherein the cross sections of the first and second pipe sockets are circular, elliptical or oval.

5. The heat exchanger as claimed in claim 3, wherein the first and second pipe sockets are connected to one another in a cohesively joined fashion in a region of the annular conical contact face.

6. The heat exchanger as claimed in claim 1, wherein the conical end regions can be produced by flaring or tapering or contraction.

7. The heat exchanger as claimed in claim 1, wherein the first and second pipe sockets are formed out of the first and second plates, respectively.

8. The heat exchanger as claimed in claim 1, wherein the annular ducts are connected to one another by the connecting duct.

9. The heat exchanger as claimed in claim 1, wherein the conical end region of the first pipe socket is flared and the conical end region of the second pipe socket is tapered.

* * * * *